US011633836B2

(12) United States Patent
Huang

(10) Patent No.: US 11,633,836 B2
(45) Date of Patent: Apr. 25, 2023

(54) REMOVING APPARATUS

(71) Applicant: POUL CHANG METAL INDUSTRY CO., LTD., Taichung (TW)

(72) Inventor: Chia-Hao Huang, Taichung (TW)

(73) Assignee: POUL CHANG METAL INDUSTRY CO., LTD., Taichung (TW)

( * ) Notice: Subject to any disclaimer, the term of this patent is extended or adjusted under 35 U.S.C. 154(b) by 0 days.

(21) Appl. No.: 17/378,046

(22) Filed: Jul. 16, 2021

(65) Prior Publication Data

US 2023/0020995 A1 Jan. 19, 2023

(51) Int. Cl.
*B25B 5/10* (2006.01)
*B25B 27/00* (2006.01)

(52) U.S. Cl.
CPC ..... *B25B 5/101* (2013.01); *B25B 27/0035* (2013.01)

(58) Field of Classification Search
CPC . B25B 27/0035; B25B 27/023; B25B 27/062; B25B 27/06; B25B 5/101; Y10T 29/49822; Y10T 29/53843; Y10T 29/53952
USPC ..... 29/257, 426.5, 263, 280; 269/143, 249; 81/52, 60, 177.2, 177.85, 185, 473, 478
See application file for complete search history.

(56) References Cited

U.S. PATENT DOCUMENTS 7,610,664 B2 * 11/2009 Wridt ..... B25B 27/062 29/257
2009/0078093 A1 * 3/2009 Suski, Jr. ..... B25B 23/0021 81/121.1

FOREIGN PATENT DOCUMENTS

TW M295002 8/2006
TW M543147 U * 6/2017

OTHER PUBLICATIONS

TWM543147U—Machine Translation (Year: 2017).*

* cited by examiner

*Primary Examiner* — Lee D Wilson
*Assistant Examiner* — Alberto Saenz
(74) *Attorney, Agent, or Firm* — Muncy, Geissler, Olds & Lowe, P.C.

(57) ABSTRACT

A removing apparatus includes a main body, an operation member, and two connection members. The main body has a main arm, and a first and second side arms on two ends, so as to form a C shape, with a combination bore on one end of one side arm away from the main arm. The operation member is on another side arm and axially movable, with another combination bore on one end of the operation member. Each connection member has a base portion, with an insertion portion extending from the one lateral side of the base portion to be combined with the combination bore. Each connection member has a large and a small column portions connected in a stage shape to form a stage face. Sleeves of different sizes can be combined with the lateral side or the stage face of the connection member for removing objects.

9 Claims, 8 Drawing Sheets

REMOVING APPARATUS

BACKGROUND OF THE INVENTION

1. Field of the Invention

The present invention relates to removing apparatuses, and more particularly, to a removing apparatus able to be combined with a wrench for removing object.

2. Description of the Related Art

As shown by Taiwan utility model patent M295002, a ball joint removing and installing tool for vehicle is disclosed, comprising a C clamp, a removing sleeve, a removing push seat, an installing sleeve, and a combining seat for carrying out the removing and installing operations. However, for such ball joint removing and installing tool for vehicle, differently sized removing sleeves and installing sleeves have to be replaced according to the sizes of the target ball joint. Therefore, a plurality of removing sleeves and installing sleeves having different sizes are needed, so that the overall volumes of the tool is large, thus requiring a relatively large storage space.

There is another type of removing tool, which is used with commercially available wrench sleeve in the market for carrying out the removing operation of objects such as a ball joint or bushing. The removing tool comprising a rectangular combination head, so as to receive a sleeve like a wrench. Therefore, a suitable sleeve is needed to be received thereon for removing objects. Because the sleeve is not the component included in such removing tool, additional space for the sleeve is saved, so as to reduce the overall volume of the removing tool. However, due to different specifications of sleeves in the market (such as ¼, ⅜, ½, and ¾ inches), such removing tool still requires a plurality of rectangular combination heads for each specification, and those combination heads still require a relative large storage space, causing inconvenience of storage and portability thereof.

SUMMARY OF THE INVENTION

To improve the issues above, a removing apparatus is disclosed for combination with a sleeve for carrying the removing and installing of an object.

For achieving the aforementioned objectives, a removing apparatus in accordance with an embodiment of the present invention comprises a main body, an operation member, and two connection members. The main body comprises a main arm, with a first side arm and a second side arm disposed on two ends of the main arm, respectively, so as to form a C shape, and a first combination bore is formed on one end of the first side arm away from the main arm. The operation member is disposed on one end of the second side arm away from the main arm. The operation member is pivotally movable and comprises a second combination arm on one end thereof, and the second combination bore corresponds to the first combination bore. Each connection member comprises a base portion. Each base portion has a first lateral side and a second lateral side in opposite to the first lateral side. Each connection member has an insertion portion extending from the first lateral side. One of the two connection members is combined with the first combination bore with the insertion portion thereof, while the other connection member is combined with the second combination bore with the insertion portion thereof. Each connection member comprises a large column portion and the small column portion coaxially extending from the second lateral side thereof. The large column portion and the small column portion are arranged in a stage shape, with a stage face formed between the large column portion and the small column portion. Each connection member is able to the combined with differently sized sleeves by use of the second lateral side or the stage face thereof.

With the second lateral side or the stage face of the combination member, the removing apparatus of the present invention can be combined with differently sized sleeves, thereby reducing the amount of the connection members of the removing apparatus and lowering the volume thereof, so as to facilitate the storage and portability of the present invention.

DETAILED DESCRIPTION OF THE INVENTION

Figure 1:
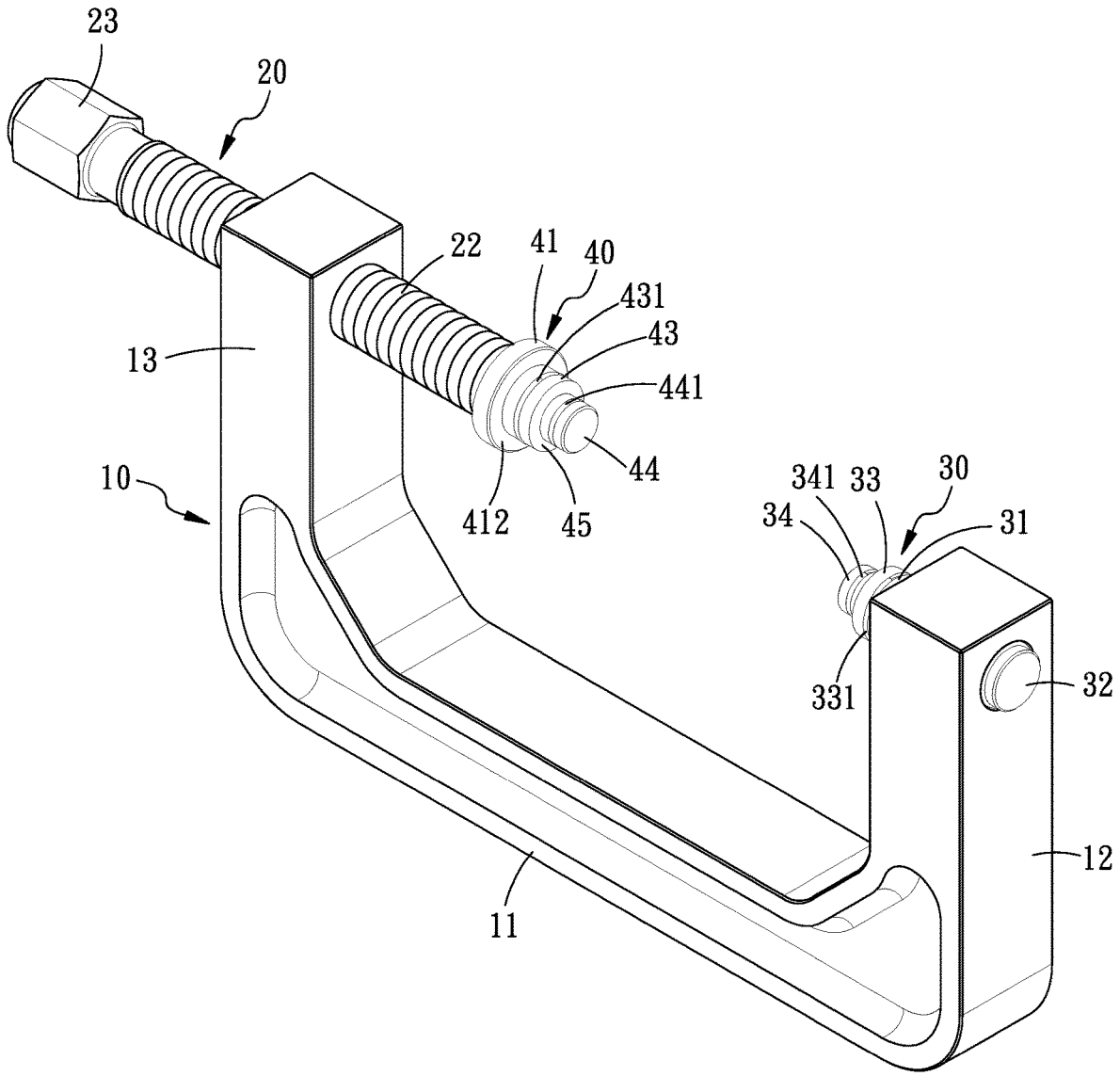
FIG. 1 is a perspective view of the removing apparatus in accordance with an embodiment of the present invention.
Figure 2:
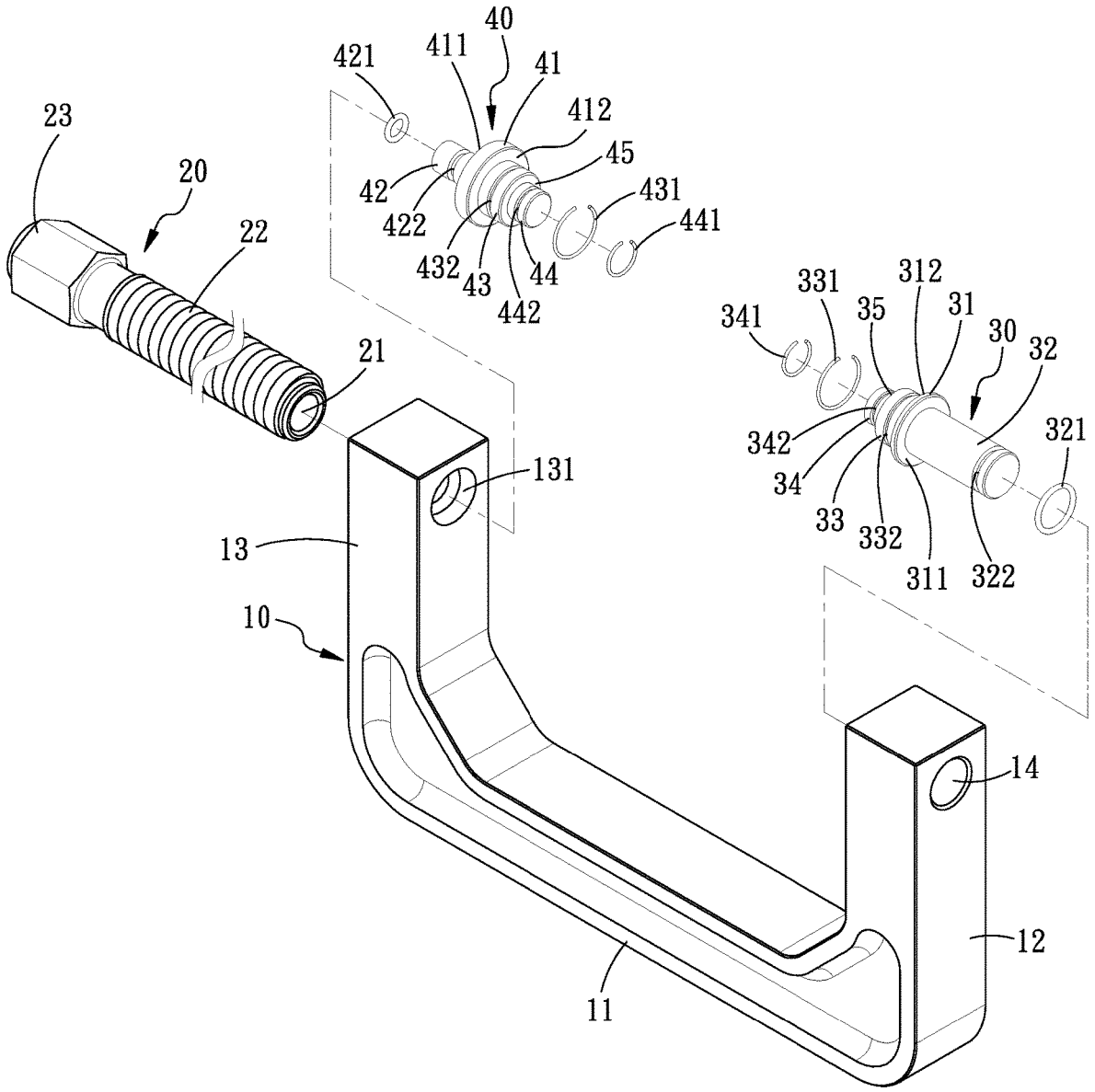
FIG. 2 is an exploded view of the removing apparatus in accordance with an embodiment of the present invention.

The aforementioned and further advantages and features of the present invention will be understood by reference to the description of the preferred embodiment in conjunction with the accompanying drawings where the components are illustrated based on a proportion for explanation but not subject to the actual component proportion.

Referring to FIG. 1 to FIG. 8, the present invention provides a removing apparatus 100, comprising a main body 10, an operation member 20, a connection member 30, and a combination member 40.

The main body 10 comprises a main arm 11, with a first side arm 12 and a second side arm 13 disposed on two ends of the main arm 11, respectively, by which the main body 10 is formed in an approximate C shape. A first combination bore 14 is formed on one end of the first side arm 12 away from the main arm 11. In an embodiment of the present invention, the first side arm 12 and the second side arm 13 are arranged in parallel. Also the corners of the first side arm 12 and the second side arm 13 connecting the main arm 11 are formed in a bevel shape.

The operation member 20 is disposed on one end of the second side arm 13 away from the main arm 11 and is axially movable on the main arm 11. A second combination bore 21 is formed on one end of the operation member 20 corresponding to the first combination bore 14. In an embodiment of the present invention, a thread bore 131 is formed on one end of the second side arm 13 away from the main arm 11, and the operation member 20 comprises an external thread 22 which is arranged along the length direction of the operation member 20, such that the operation member 20 is screwedly combined to the thread bore 131 with the external thread 22. Also, the operation member 20 has a drive portion 23 on end thereof, and the drive portion 23 is driven to rotate the operation member 20. Therefore, through the rotation of the external thread 22 in the thread bore 131, the operation member 20 axially moves.

Preferably, the thread bore 131 on one end of the second side arm 13 is coaxially disposed with the first combination bore 14, and the drive portion 23 in the embodiment is formed in a hexagonal shape for being received and driven by a fix wrench or adjustable wrench. Also, in the embodiment, the first combination bore 14 and the second combination bore 21 are formed in a circular shape.

The connection member 30 comprises a base portion 31 having a first lateral side 311 and an opposite second lateral side 312. The connection member 30 has an insertion portion 32 extending from the first lateral side 311. In the embodiment, the insertion portion 32 is formed in a circular rod shape and combined to the first combination bore 14. Therein, each connection member 30 comprises a large column portion 33 and a small column portion 34 coaxially extending form the second lateral side 312, wherein the large column portion 33 and the small column portion 34 are connected to form a stage shape, with a stage face 35 is formed therebetween. The diameter of the large column portion 33 is ¾ inches, and the diameter of the small column portion 34 is ½ inches.

Figure 3:
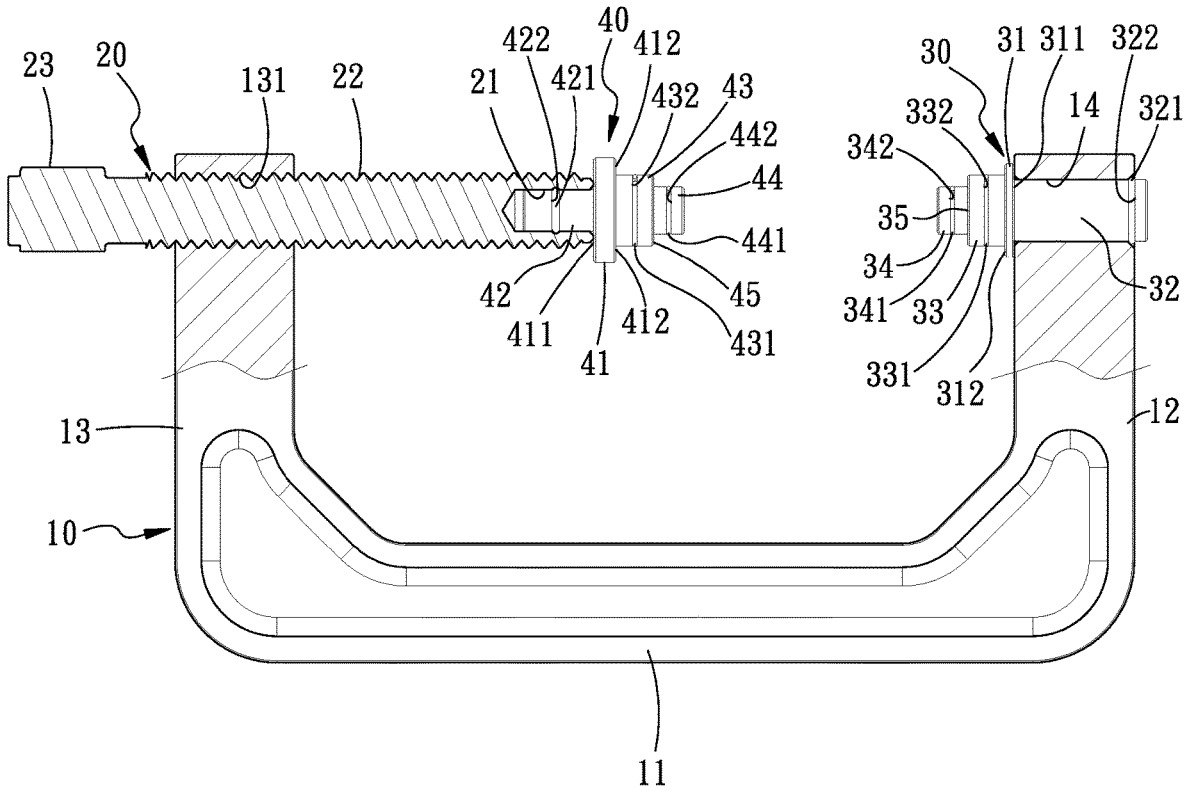
FIG. 3 is a plan and partially sectional view of the removing apparatus in accordance with an embodiment of the present invention.

In addition, the insertion portion 32 comprises a first flexible ring 321 and a first groove 322 circularly formed thereon. In the embodiment, the first flexible ring 321 is formed of a resin material and engaged in the first groove 322. When the insertion portion 32 is inserted in the first combination bore 14, the first flexible ring 321 provides a positional fixation effect (as shown in FIG. 3).

Figure 5:
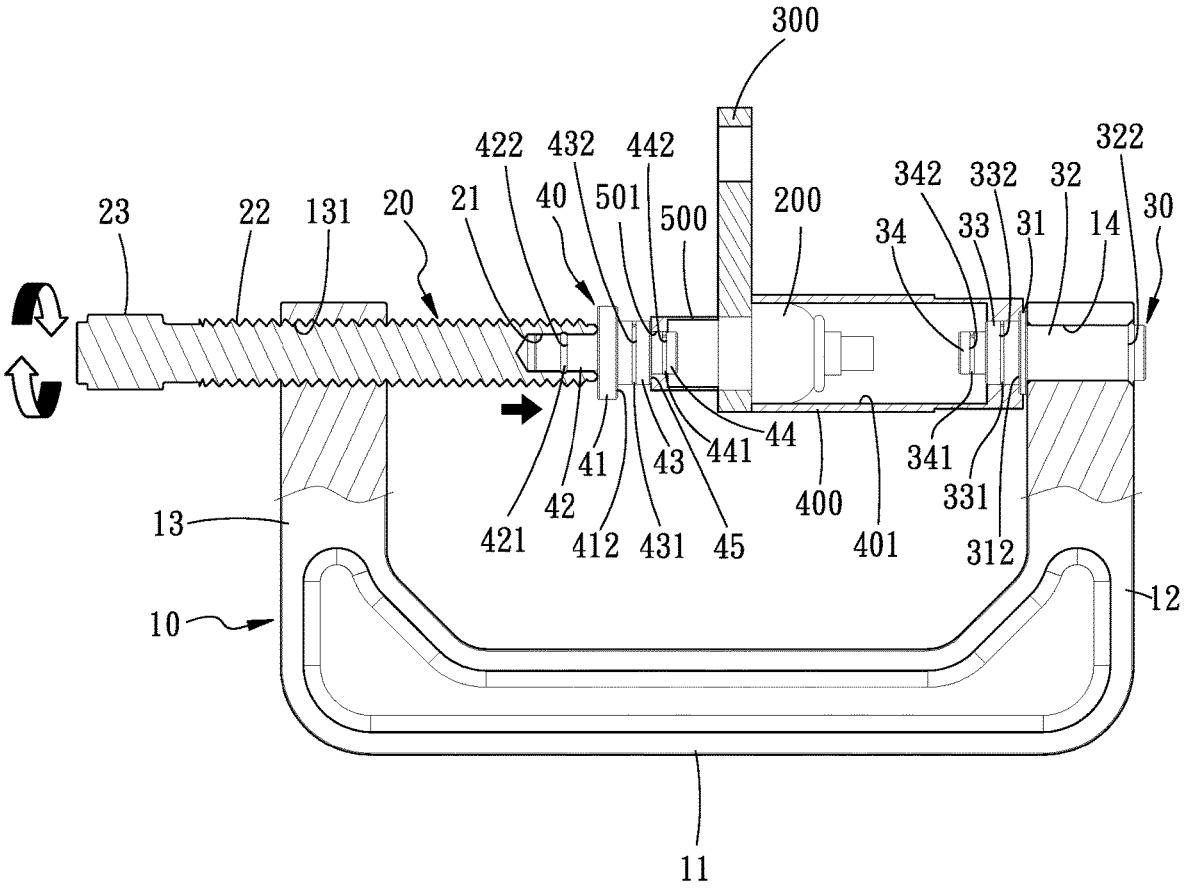
FIG. 5 is a schematic view illustrating the operation status of the removing tool applied for removing a boll joint.

The large column portion 33 comprises a second flexible ring 331 and a second groove 332 circularly formed thereon. In the embodiment, the second flexible ring 331 is formed of a resin material and engaged in the second groove 332. When the large column portion 33 is engaged in a receive bore 401 of a sleeve 400, the second flexible ring 331 provides a positional fixation effect (as shown in FIG. 5).

The small column portion 34 comprises a third flexible ring 341 and a third groove 342 circularly formed thereon. In the embodiment, the third flexible ring 341 is formed of a resin material and engaged in the third groove 342. When the small column portion 34 is engaged with the sleeve 400, the third flexible ring 341 provides a positional fixation effect.

The connection member 40 is structurally similar to the connection member 30. The connection member 40 comprises a base portion 41 having a first lateral side 411 and an opposite second lateral side 412. The connection member 40 has an insertion portion 42 extending from the first lateral side 411. In the embodiment, the insertion portion 42 is formed in a circular rod shape and slightly smaller than the insertion portion 32, so as to be combined to the second combination bore 21. Therein, each connection member 40 comprises a large column portion 43 and a small column portion 44 coaxially extending form the second lateral side 412, wherein the large column portion 43 and the small column portion 44 are connected to form a stage shape, with a stage face 45 is formed therebetween. The diameter of the large column portion 43 is ¾ inches, and the diameter of the small column portion 44 is ½ inches.

In addition, the insertion portion 42 comprises a first flexible ring 421 and a first groove 422 circularly formed thereon. In the embodiment, the first flexible ring 421 is formed of a resin material and engaged in the first groove 422. When the insertion portion 42 is inserted in the second combination bore 21, the first flexible ring 421 provides a positional fixation effect (as shown in FIG. 3).

The large column portion 43 comprises a second flexible ring 431 and a second groove 432 circularly formed thereon. In the embodiment, the second flexible ring 431 is formed of a resin material and engaged in the second groove 432. When the large column portion 43 is engaged in a sleeve, the second flexible ring 431 provides a positional fixation effect.

The small column portion 44 comprises a third flexible ring 441 and a third groove 442 circularly formed thereon. In the embodiment, the third flexible ring 441 is formed of a resin material and engaged in the third groove 442. When the small column portion 44 is engaged with a receive bore 501 of a sleeve 500, the third flexible ring 441 provides a positional fixation effect (as shown in FIG. 5).

Figure 4:
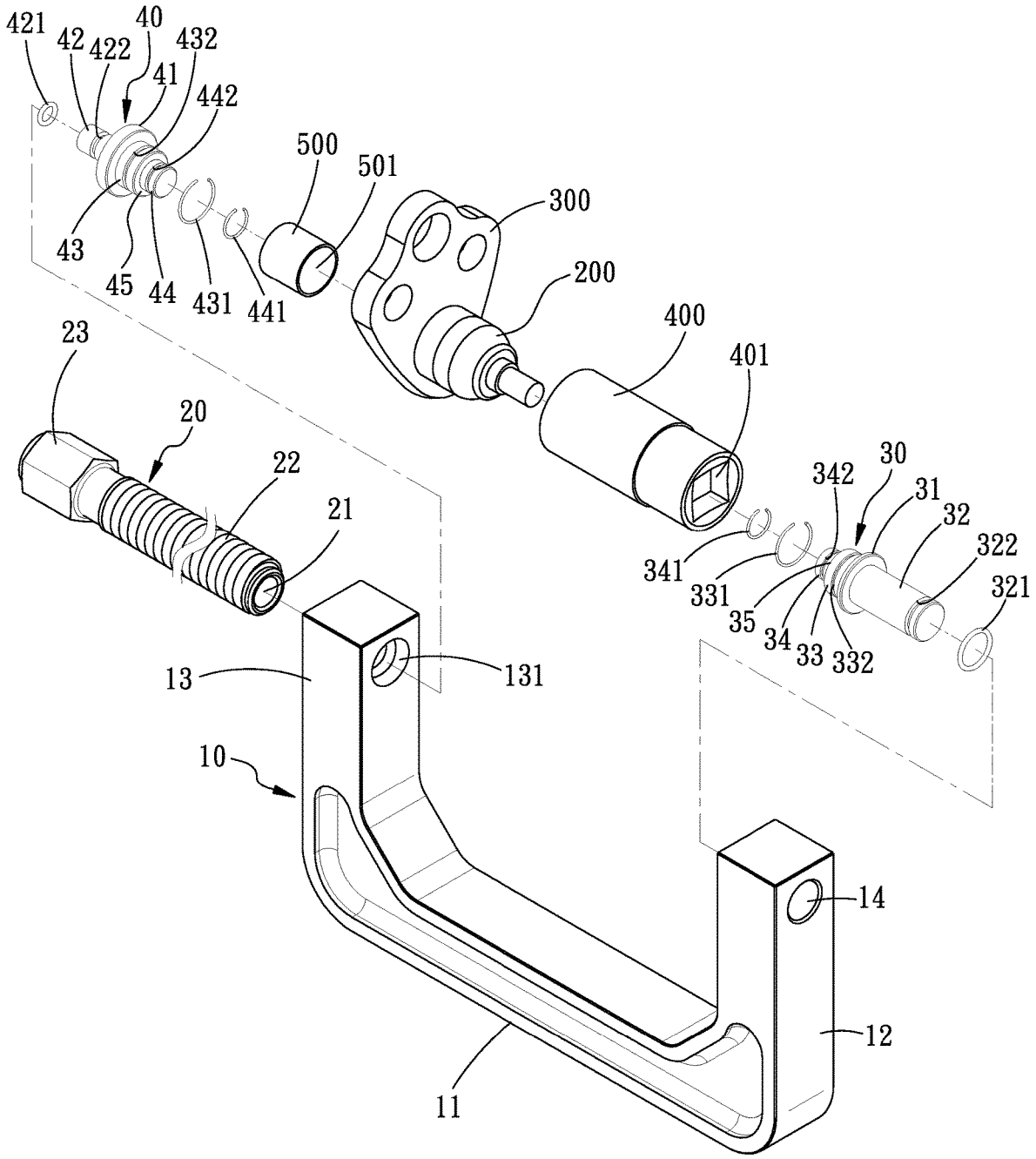
FIG. 4 is a schematic view illustrating the relative positional relationship of components of the removing tool applied for removing a boll joint.

During operation, for example, a target removing object is a ball joint 200 to be removed from a supporter 300, as shown in FIG. 4 and FIG. 5. When the receive bore 401 of one suitable sleeve 400 has a diameter of ¾ inches, and the receive bore 501 of another suitable sleeve 500 has a diameter of ½ inches, those sizes match the sizes of the large column portion 33, 43 and the small column portions 34, 44 of the aforementioned two connection members 30, 40. Therefore, the connection member 30 is inserted in the first combination bore 14 through the insertion portion 32, and the connection member 40 is inserted in the second combination bore 21 through the insertion portion 42.

Figure 6:
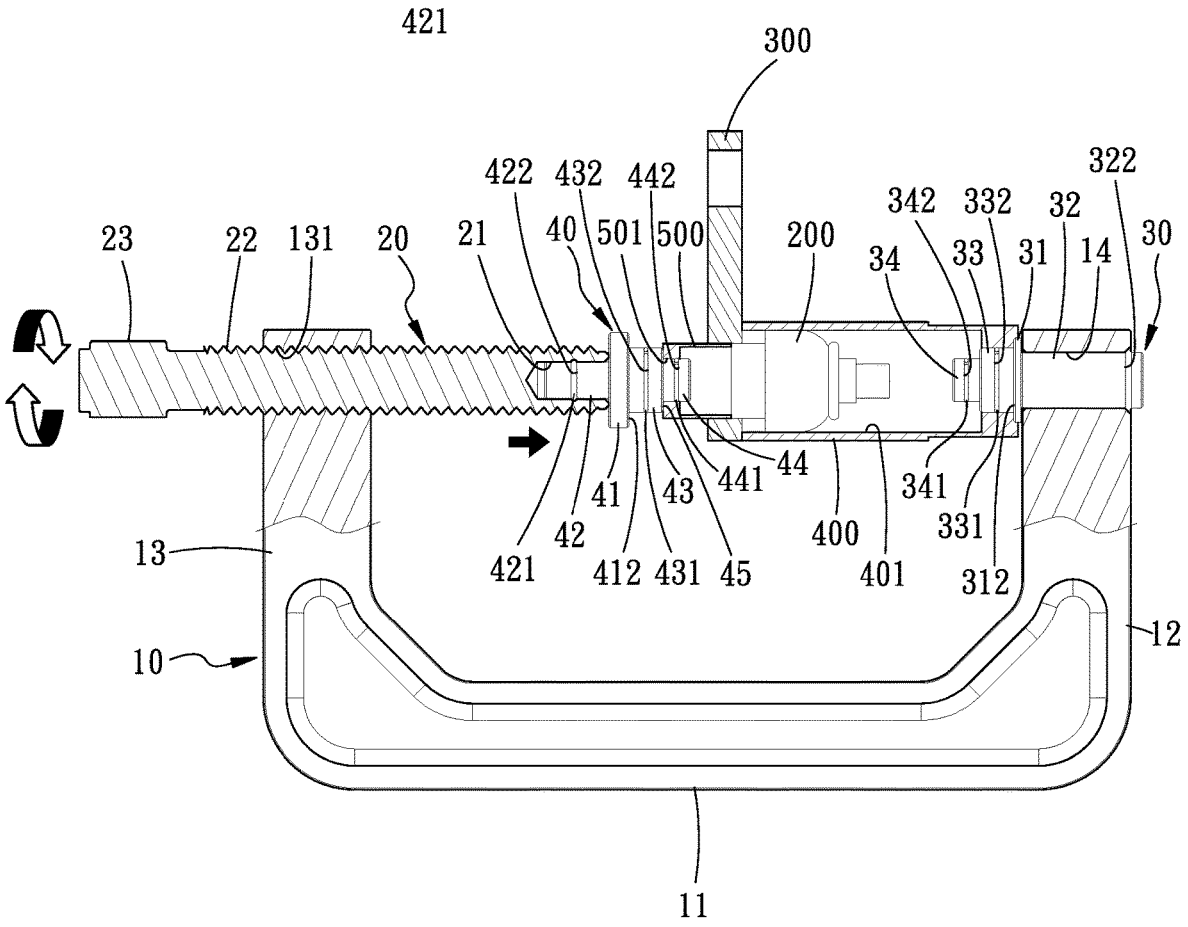
FIG. 6 is a schematic view illustrating the status of the removing tool forcing the ball joint out from the supporter in FIG. 5.

Next, the sleeve 400 is mounted around the large column portion 33 through the receive bore 401 to contact the second lateral face 312, and the sleeve 500 is mounted around the small column portion 44 through the receive bore 501 to contact the stage face 45, whereby the second flexible ring 331 and the first flexible ring 421 provide a positional fixation effect. Then, referring to FIG. 5, an end edge of the sleeve 500 is abutted against one end of the ball joint 200, with the ball joint 200 placed into the sleeve 400. Then, a wrench (not shown) is applied for combining the drive portion 23 for rotating the operation member 20, so as to drive the sleeve 500 combined with the connection member 40 for forcing the ball joint 200 to be separated from the supporter 300 (as shown by FIG. 6) until the ball joint 200 is completely separated with the supporter 300 in the sleeve 400, removing the ball joint 200 from the supporter 300.

Figure 7:
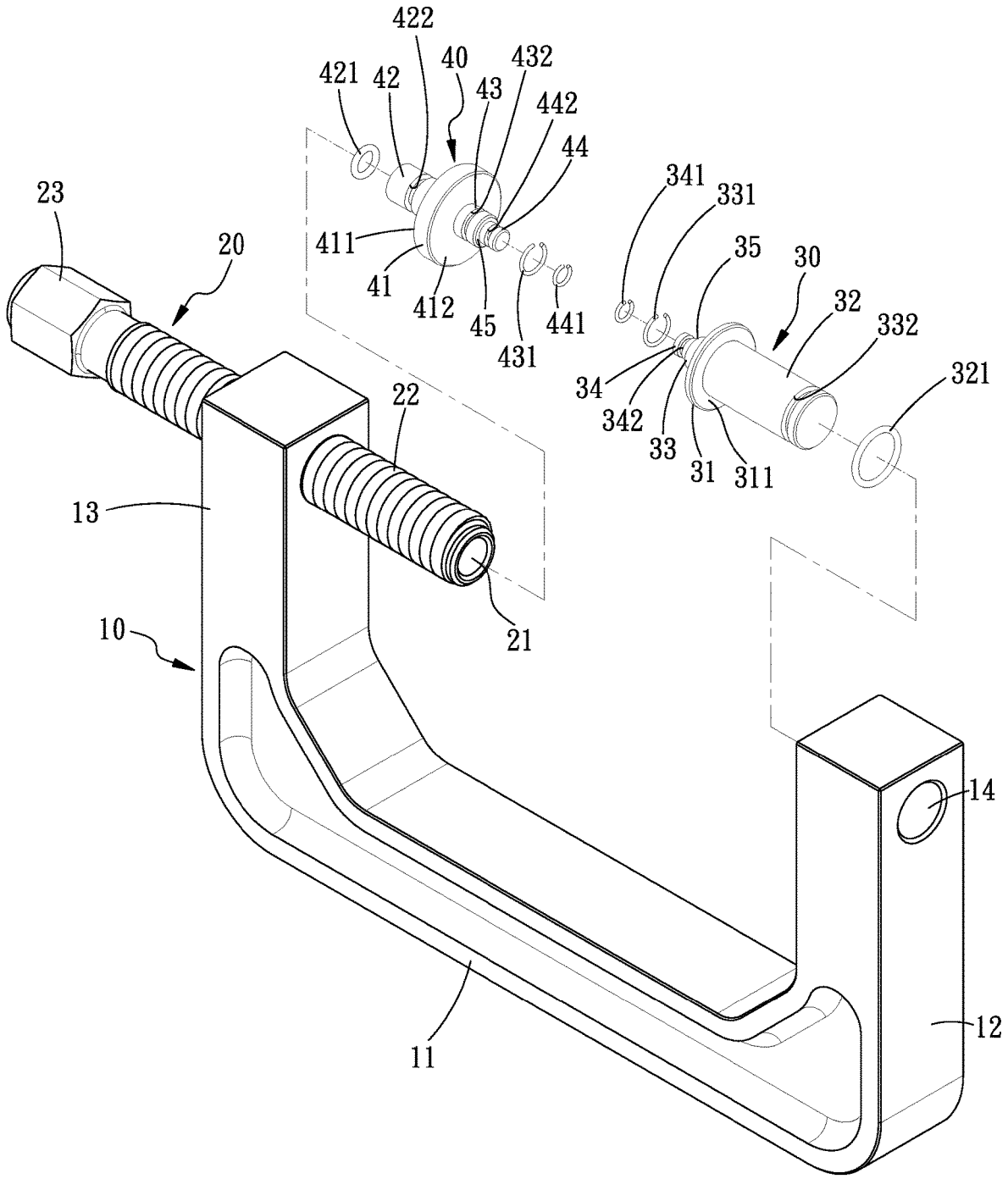
FIG. 7 is a perspective view of the removing apparatus in accordance with a second embodiment of the present invention.

Surely, there are still many examples of the present invention, in which only details are changed. Referring to FIG. 7, a second embodiment of the present invention is shown. The difference from the first embodiment lies in that the diameter of the large column portion 33 of the connection member 30 is ⅜ inches, and the diameter of the small column portion 34 is ¼ inches. Also, the diameter of the large column portion 43 of the connection portion 40 is ⅜ inches, and the diameter of the small column portion 44 is ¼ inches as well. Therefore, compared with the first embodiment, other sleeves with different specifications can be applied to the present invention.

Figure 8:
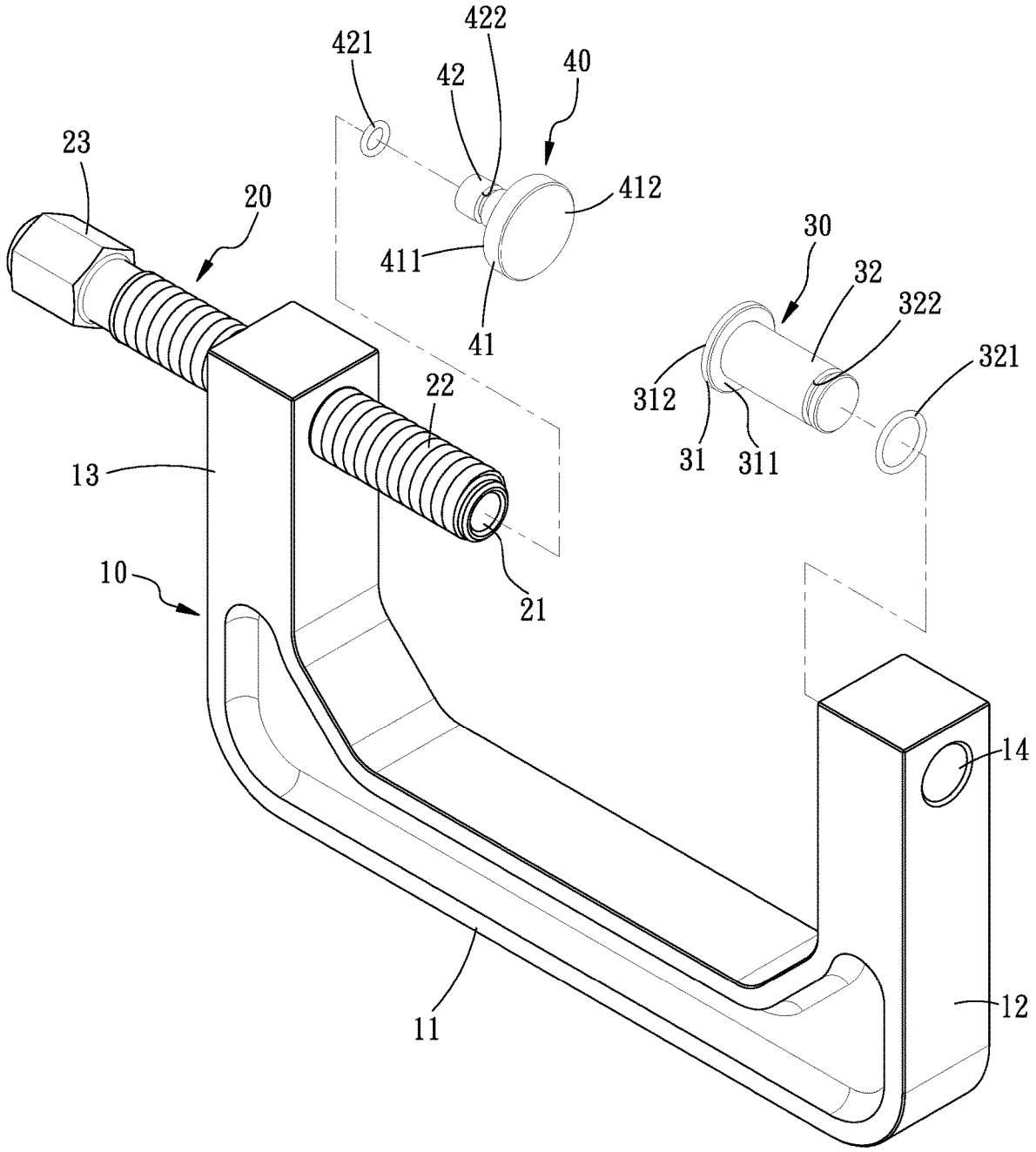
FIG. 8 is a perspective view of the removing apparatus in accordance with a third of the present invention.

Referring to FIG. 8, a third embodiment of the present invention is shown. The difference from the first and second embodiments lies in that the second lateral side 312 of the connection member 30 is a flat face without the large column portion 33 and the small column portion 34 in the first and second embodiments. Further, the second lateral side 412 of the connection member 40 is also a flat face without the large column portion 33 and the small column portion 34 in the first and second embodiments. Compared with the first and second embodiments, other sleeves with different specifications can be applied to directly contact the second lateral side 312 or the second lateral side 412 of the present invention.

With the foregoing configuration, effects of the present invention will be illustrated below. Regarding the removing apparatus 100 of the present invention, the connection member 30, 40 comprises the second lateral side 312, 412, with the large column portion 33, 43 and the small column portion 34, 44 extending from the second lateral side 312, 412 to form a stage face 35, 45, the sleeve 400 with a larger size can be mounted on the large column portion 33 through the receive bore 401 to contact the second lateral face 312, and the sleeve 500 with smaller size can be mounted around the small column portion 44 through the receive bore 501 to contact the stage face 45. Also, the connection members 30, 40 in different embodiments can be mixed for usage, wherein the same connection members 30, 40 are able to be combined with sleeves having different specifications, thereby reducing the amount of connection members 30, 40 required by the removing apparatus 100. Therefore, the embodiments above reduce half of the amounts of the needed connection members 30, 40 compared with conventional removing tools. The volume of the removing apparatus 100 is effectively lowered, facilitating the storage and portability thereof.

Further, with the first flexible ring 321, second flexible ring 331, third flexible ring 341, first flexible ring 421, second flexible ring 431, and third flexible ring 441, when the present invention is combined with a receive hole or sleeve, a positional fixation effect is achieved.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A removing apparatus, comprising:

a main body comprising a main arm, with a first side arm and a second side arm disposed on two ends of the main arm, respectively, so as to form a C shape, and a first combination bore formed on one end of the first side arm away from the main arm;

an operation member disposed on one end of the second side arm away from the main arm, the operation member being axially movable, with a second combination bore formed on one end of the operation member, the second combination bore corresponding to the first combination bore; and two connection members each having a base portion, each base portion comprising a first lateral side and a second lateral side opposite to the first lateral side, each connection member comprising an insertion portion extending from the first lateral side, one of the two connection members combined with the first combination bore through the insertion portion thereof, and the other of the two connection members combined with the second combination bore through the insertion portion thereof; each connection member comprising a large column portion and a small column portion coaxially extending from the second lateral side; the large column portion and the small column portion being connected to form a stage shape, with a stage face formed therebetween; each connection member being combined with differently sized sleeves through the second lateral side or the stage face;

wherein the large column portions of the two connection members have an identical diameter, and the small column portions of the two connection members have an identical diameter; each insertion portion of the two connection members comprises a first flexible ring, such that when the insertion portion is inserted in the first combination bore or the second combination bore, the corresponding first flexible ring provides a positional fixation effect each large column portion of the two connection members comprises a second flexible ring, such that when the large column portion is combined with the sleeve, the corresponding second flexible ring provides a positional fixation effect each small column portion of the two connection members comprises a third flexible ring, such that when the small column portion is combined with the sleeve, the corresponding third flexible ring provides a positional fixation effect.

2. The removing apparatus of claim 1, wherein the second side arm comprises a thread bore formed on one end thereof away from the main arm; the operation member comprises an external thread disposed along a length direction of the operation member, and also comprises a drive portion which is able to be driven to rotate on one end of the operation member; the operation member is screwedly combined to the thread bore through the external thread, such that the operation member is axially movable along an axial direction of the thread bore.

3. The removing apparatus of claim 2, wherein the thread bore and the first combination bore are disposed in a coaxial arrangement.

4. The removing apparatus of claim 2, wherein the drive portion is formed in a hexagonal shape.

5. The removing apparatus of claim 1, wherein the first side arm and the second side arm are arranged in parallel.

6. The removing apparatus of claim 1, wherein the insertion portions of the two connection members are formed in a circular rod shape; the first combination bore and the second combination bore are formed in a circular bore.

7. The removing apparatus of claim 1, wherein each insertion portion of the two connection members comprises a first groove circularly formed thereon, with each first flexible ring being engaged with the corresponding first groove.

8. The removing apparatus of claim 1, wherein each large column portion of the two connection members comprises a second groove circularly formed thereon, with each second flexible ring being engaged with the corresponding second groove.

9. The removing apparatus of claim 1, wherein each small column portion of the two connection members comprises a third groove circularly formed thereon, with each third flexible ring being engaged with the corresponding third groove.

* * * * *